United States Patent [19]

Molitor

[11] 4,007,566

[45] Feb. 15, 1977

[54] COPING AND GUTTER FOR RIM FLOW SWIMMING POOLS

[75] Inventor: Victor D. Molitor, Denver, Colo.

[73] Assignee: Stainless Equipment Company, Englewood, Colo.

[22] Filed: June 25, 1973

[21] Appl. No.: 373,143

[52] U.S. Cl. ..... 52/169.7; 52/300; 4/172.21

[51] Int. Cl.[2] ..... E04H 12/00; E02D 27/00

[58] Field of Search ..... 151/38; 210/169, 164, 210/165; 4/172.17, 172.18, 172.19, 172.21; 52/302, 12–16, 169, 198, 364, 365, 306

[56] References Cited

UNITED STATES PATENTS

| | | | |
|---|---|---|---|
| 1,256,905 | 2/1918 | Kass | 52/180 |
| 1,578,161 | 3/1926 | Monroe | 151/38 |
| 1,743,623 | 1/1930 | Ross | 29/DIG. 36 |
| 1,793,453 | 2/1931 | Barili | 151/38 |
| 2,374,309 | 4/1945 | Roxs | 151/38 |
| 2,890,664 | 6/1959 | Rachlin | 52/11 |
| 3,011,178 | 12/1961 | Stone | 4/172.18 |
| 3,298,039 | 1/1967 | Schmerler | 4/172.21 |
| 3,319,264 | 5/1967 | Scarano | 4/172.17 |
| 3,351,206 | 11/1967 | Wennerstrom | 210/474 |
| 3,436,878 | 4/1969 | Singer | 52/12 |
| 3,499,254 | 3/1970 | Jefferys | 52/179 |
| 3,546,719 | 12/1970 | Bishop | 4/172.17 |
| 3,631,545 | 1/1972 | Orndorff | 52/169 |
| 3,668,712 | 6/1972 | Baker | 210/169 |
| 3,826,048 | 7/1974 | Merkin et al. | 52/11 |
| 3,835,481 | 9/1974 | Engelhart | 52/179 |

FOREIGN PATENTS OR APPLICATIONS

| | | | |
|---|---|---|---|
| 734,648 | 5/1966 | Canada | 52/12 |
| 354,957 | 1905 | France | 52/182 |

*Primary Examiner*—James L. Ridgill, Jr.
*Attorney, Agent, or Firm*—Horace B. Van Valkenburgh; Frank C. Lowe

[57] ABSTRACT

The coping is mounted atop the gutter and each is formed of stainless steel, with the top surfaces being sandblasted to prevent slipperiness, particularly when wet. The gutter, which carries water overflowing and draining through slots in the coping, is also used as a form for pouring the concrete walls of the pool. The gutter provides not only check points for transit leveling, but also an upper rear flange for use in leveling the top of the concrete when poured.

The rear of the coping is supported by the gutter, while the depending front wall of the coping is supported by an upwardly extending front wall of the gutter, at an outward offset of each, through a series of special, fine adjustment connecting devices. The upstanding front nose of the coping determines the level at which water will overflow, while the various sections of the coping may be adjusted through the fine adjustment devices, to correspond with the water level, thereby providing a highly accurate level setting for the rim. The sections of the gutter are abutted and attached together to provide greater solidity, but the sections of the coping are spaced apart to provide slots through which a small amount of water may flow continuously, so that the gutter will never run dry and require repriming of the pumps. Both the coping and the gutter are reinforced by transverse braces on the underside of the coping and within the gutter, as well as on the underside of the gutter. In addition, a series of hooks are attached to the underside of the gutter, for embedment in the concrete. A drain pipe, at one or more positions and with a surge preventing baffle above its opening, as well as an overflow pipe which extends upwardly to a point at or above the top of the upper transverse brace of the gutter, are connected to piping which leads to the return flow pump and a drain, respectively, before the concrete is poured.

1 Claim, 10 Drawing Figures

COPING AND GUTTER FOR RIM FLOW SWIMMING POOLS

This invention relates to a coping and gutter for rim flow swimming pools.

As used herein, the terms "inward" or "inner" and "outward" or "outer" refer to a direction toward and away from the pool per se, respectively, since poolsare normally rectangular or a variation of rectangular shape and are normally completely surrounded by the gutteer and coping.

BACKGROUND OF THE INVENTION

Rim flow swimming pools are old. For instance, the outdoor swimming pool at Glenwood Springs, Colo., the water to which is derived from natural springs from which the water issues at a temperature of above 100° F, is a rim flow swimming pool which has been in existence for half a century or more. In this pool, the overflow of water from the pool takes place over the rim and is drained through openings in slabs spaced apart along the drain gutter, which is spaced from the edge of the pool. These drain slabs are relatively thick and heavy and are removable for access to the drain at spaced intervals, for cleaning purposes.

Other rim flow swimming pools are disclosed in prior U.S. patents. For instance, Booraem et al U.S. Pat. No. 1,797,397 of 1931 shows a rim flow swimming pool in which the rim has an upstanding nose at the edge of the pool. Both a portion of the upper edge of the pool and the inner wall and bottom of the gutter, for removing water drained from the pool, are formed by a relatively hevy casting, while a second heavy casting forms the outer wall of the gutter and an upstanding barrier, together with a second drain gutter further outwardly from the edge of the pool. Castings with slots cover each of the drain gutters. Variations of this construction are also shown by Booraem et al, although each involves relatively heavy castings.

Kennedy, U.S. Pat. No. 2,982,970 of 1961 shows a swimming pool edge structure in which a drain gutter is formed in the concrete which surrounds the pool, and a cast grate bridges this drain gutter, the cast grate having an inner nose and a series of slots, for drainage of water into the gutter beneath, but the nose is supported by spaced, depending elements between which water also drains from the pool.

Whitten, Jr., U.S. Pat. No. 3,386,107 of 1968 shows a rim flow swimming pool in which a rectangular, tubular member forms the edge of the pool, being placed above the wall of the pool around the edge thereof, with an angle section forming the bottom and outer wall of the drain gutter and also extending upwardly to a deck which surrounds the pool and having an outer depending flange embedded in the concrete of the deck. A slotted grating, formed in sections, is placed on top of the gutter.

Costello, U.S. Pat. No. 3,585,656 of 1971 shows a swimming pool coping construction comprising a relatively heavy grating cast from concrete or the like, and provided with reinforcement interspaced with slots in the grating. This grating is provided with an upstanding nose at the inner edge and is placed over a drain gutter formed in the concrete of which the walls of the pool are formed.

SUMMARY OF THE INVENTION

In the present invention, the coping is formed from sections of corrosion-resistant metal, stainless steel being preferred, which is formed from a sheet, to provide an inner raised nose at the edge of the pool, a depending front wall which has an outward offset at the lower edge and a depending rear wall. Between the nose and the rear wall, a series of slots, preferably parallel to the edge of the pool, are formed in the coping, which slopes slightly upwardly and rearwardly from the rear side of the raised nose. These slots may be formed by a die passing through the sheet from the top, so that the edges of the slots will be rounded in a downward direction. Although the coping may be utilized separately, without the gutteer, preferably the gutter is formed from sheet stainless steel having an upstanding front wall, with an outward offset at the top, a bottom wall and a rear wall which slants upwardly and rearwardly to a rear flange which forms the inner edge of the top of the deck spaced outwardly from the pool.

Both the gutter and the coping are provided with lateraly extending bracing on the inside, such as angles or channels, with the bracing being at spaced positions along the respective parts, and also at each end of the gutter, for longitudinal attachment of the gutter sections together.

At the corners of the pool, the abutting gutter and coping sections may fit at an angle of 45°, so as to form the corners. Or, a special rounded section of both the gutter and coping may be provided at each corner, having ends at 90° to each other and the front edge and rear edge being arcuate.

One important feature of this invention is the adjustment of a depending, outwardly offset front wall portion of the coping with respect to an upwardly extending, outwardly offset portion of the front wall of the gutter. Due to inaccuracies by contractors in erecting forms for the concrete to be poured, to form the walls of the swimming pool, the level of the deck surrounding a prior swimming pool may vary as much as ½ inch. Thus, the use of the gutter of this invention s part of the form for pouring the concrete which forms the walls and deck of the swimming pool assists materially in the accurate installation of the forms, since the bracing referred to materially prevents twisting of the gutter and the rearwardly extending lip at the top of the rear wall of the gutter provides points at which the elevation of the deck may be more accurately determined, through use of a transit. In addition, this lip also provides a more accurate surface for levelling off the concrete of the deck. However, even with the contributions toward accuracy provided by the gutter, there are still inaccuracies which persist, but these are overcome by the aforesaid adjustment between the coping and the gutter. The preferred adjustment permits upward or downward movement of the front edge of the coping to within a very small fraction of an inch at spaced positions along each section of the coping, as well as locking of the coping in adjusted position. A preferred form of the adjustment means will be described later, but essentially involves horizontal, closely spaced ridges and valleys in the back of the front wall of the coping and similarly interfitting closely spaced ridges and valleys in a corresponding portion of the front wall of the outward offset of the gutter, which is preferably extruded toward the coping, as well as a bolt and nut or similar clamping device.

A further important feature of the invention is the sandblasting of the stainless steel sheet, particularly along the top thereof, to eliminate the normal slipperiness of the stainless steel surface, particularly when wet. It has been found that stainless steel can be sandblasted, as in the manner described later, to produce a non-slip surface.

The coping adjustment means of this invention permits the coping to be leveled during installation, but particularly permits adjustment of the level of the top of the front nose of the coping, which determines the overflow level of a pool, after the pool is filled with water and high or low points, often amounting to a small fraction of an inch only determined by the water level.

BRIEF DESCRIPTION OF THE DRAWINGS

A coping and gutter for rim flow swimming pools constructed as described generally above, is shown in preferred form in the accompanying drawings, in which.

DETAILED DESCRIPTION OF THE INVENTION

Figure 1:
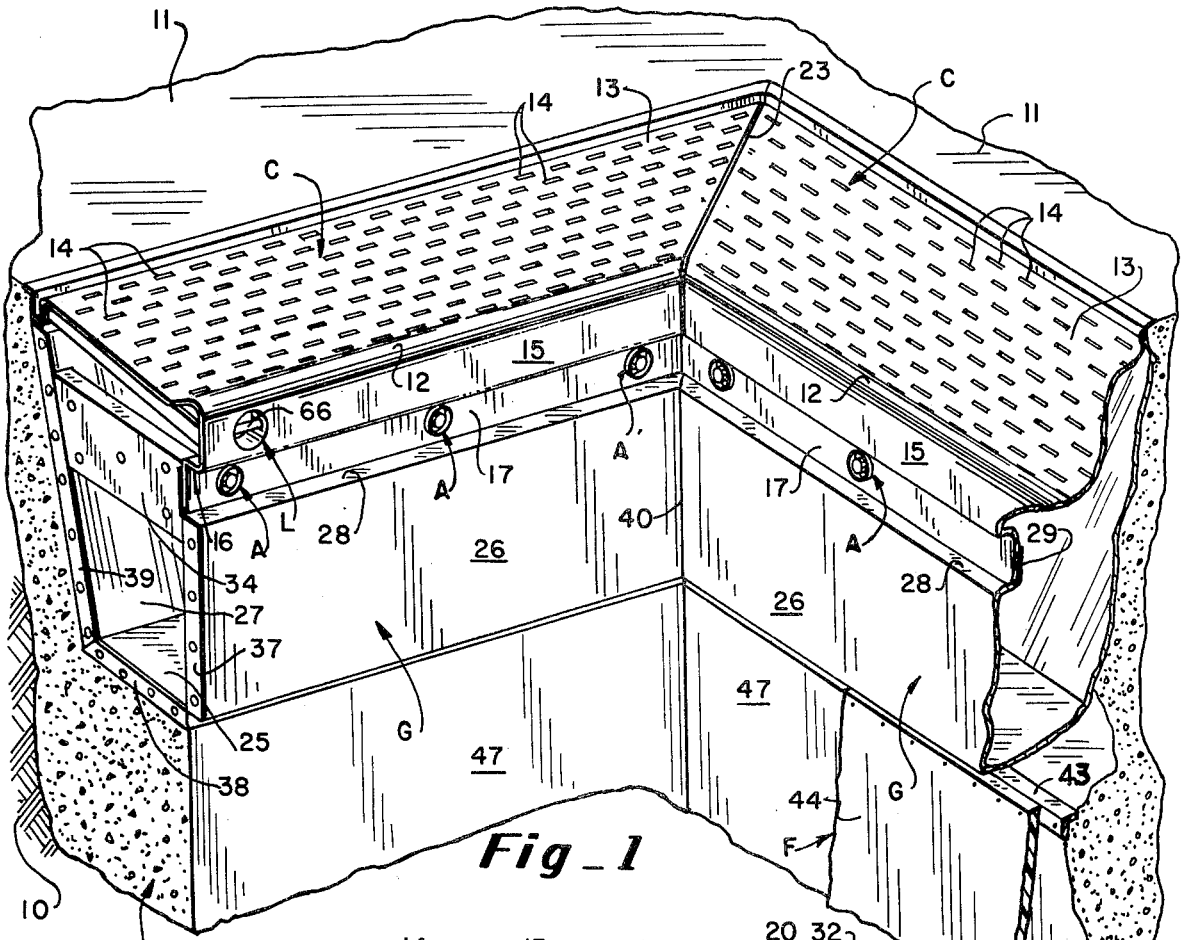
FIG. 1 is a fragmentary perspective view of one corner o a swimming pool, showing a coping and gutter constructed in accordance with this invention, the pool wall being in section at the left, at one end of corresponding sections of the coping and gutter, but broken away at an intermediate position at the right.
Figure 2:
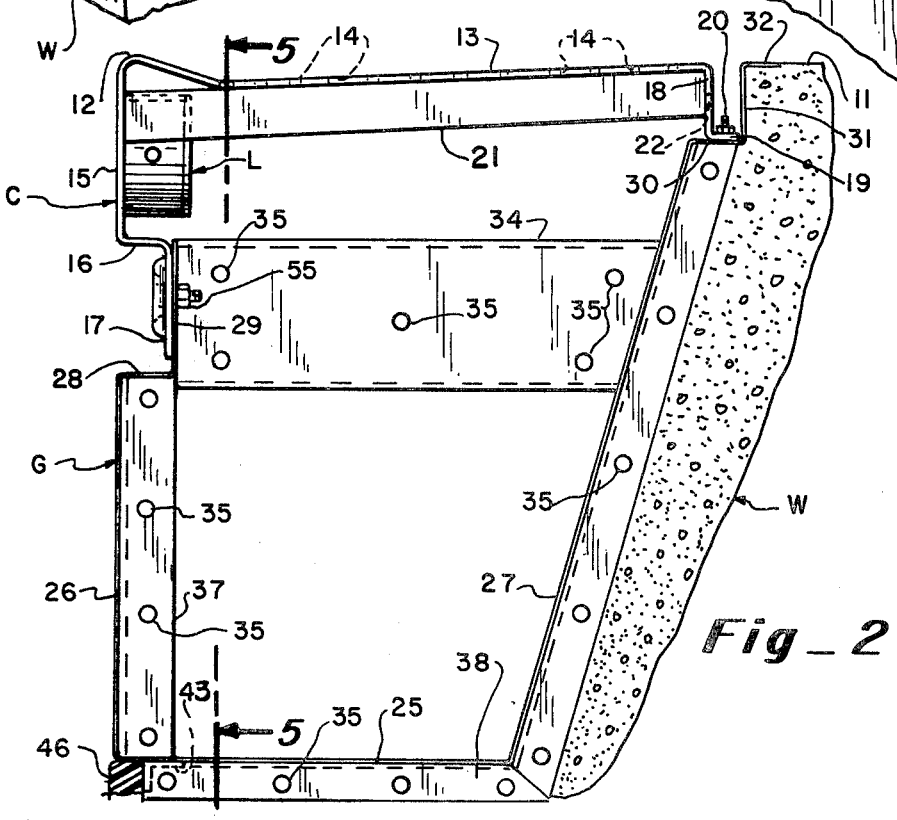
FIG. 2is a cross section taken along line 2—2 of FIG. 3, showing also a small portion of the wall of the pool.

The swimming pool rim flow coping C and gutter G, as in FIGS. 1 and 2, may be installed in a swimming pool having walls W, as of concrete, surrounding it. The coping C is provided with a series of anchors L by which lane lines or the like may be attached, while a depending outward offset of the coping is connected to an upwardly extending, outward offset of the gutter by a series of attachmentand adjustment means A. In general, the wall W, as of concrete, is poured utilizing the gutter G as the upper part of a form F, a portion of which is shown in FIG. 1, the concrete being poured in an excavation in earth 10 and up to and behind the gutter G and leveled off at a deck 11.

The coping C includes an inner, upwardly extending, rounded nose 12 from the rear of which a drain section 13 extends rearwardly and slightly upwardly. The drain section 13 is provided with a series of longitudinal slots 14 which are punched in the stainless steel sheet metal of the coping, so that the upper edge of each slot will be rounded and the slot will narrow slightly in a downward direction. The upper surface of the coping is also sandblasted, in a manner described later, to provide a non-slip surface. From the front of nose 12, a front flange extends downwardly to an outwardly offset flange 16, from which a lower attachement flange 17 depends and with which the attachment and adjustment means A cooperates for connection to the gutter G. The slots 14 may be on the order of 2 inches long and spaced about 1¾ inches apart in rows on the order of 1⅞inches apart, with the slots in one row being alternated with the slots in each adjacent row, as in FIG. 3. With the slots 14 slightly longer than the spacing between the slots, the end of each slot will overlap in a longitudinal direction with the slots in adjacent rows. The coping C further includes a rear, depending flange 18, from the lower edge of which extends a generally horizontal or rearward flange 19. The rear flange 19 is utilized in attaching the rear edge of the coping to the gutter, as by a spaced series of bolts 20 and a conventional associated nut of FIG. 2.

Figure 5:
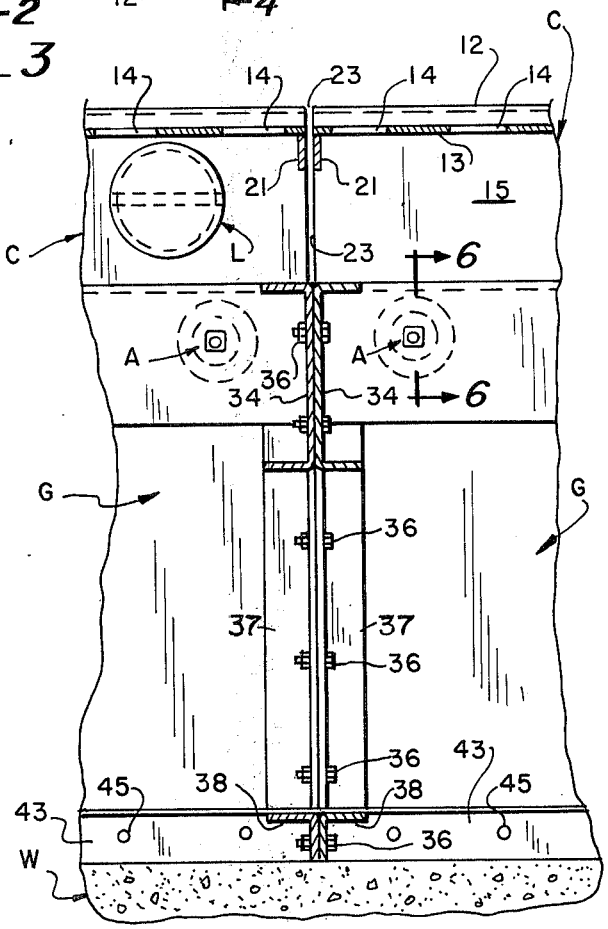
FIG. 5 is a fragmentary, longitudinal vertical section taken along line 5—5 of FIG. 3, looking inwardly toward the pool.

The coping C is further provided with a series of spaced brace bars 21, for which angles or channels may be substituted, and which extend between the front depending flange 15 and the rear depending flange 18, with the ends of each brace bar being welded to the respective flange and a brace bar adjacent each end of a section, as in FIG. 5. The brace bars 21 may be spaced approximately 1 foot apart and are shaped to engage the underside of and support the drain section 13, as in FIG. 2. The rear flange 18 may also be provided with a series of spaced weep holes 22, as indicated in dotted lines in FIG. 2, for a purpose hereinafter described. The weep holes 22 may be placed an appropriate distance apart, such as at approximately the centerlines of the slots 14 in the row adjacent the rear edge of drain section 13.

Figure 3:
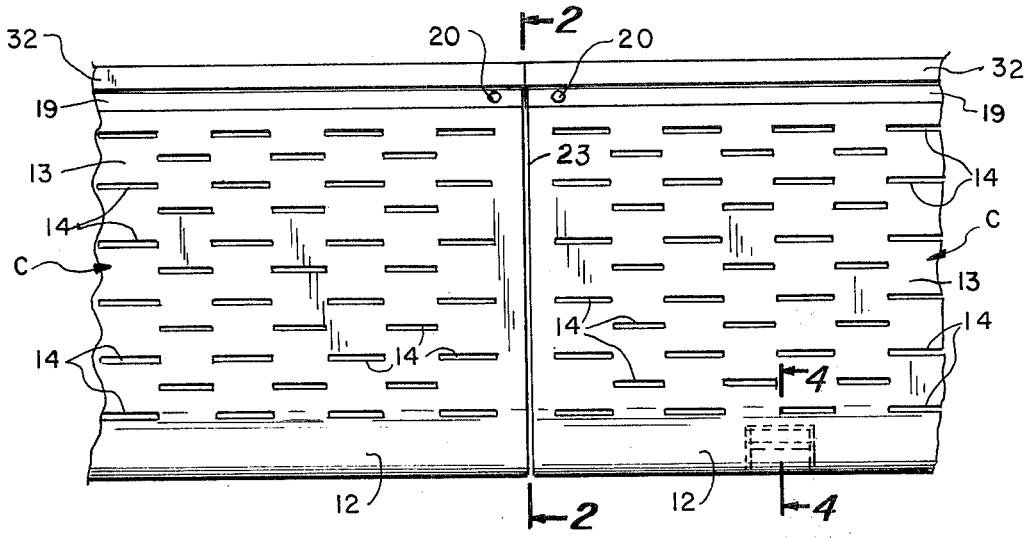
FIG. 3 is a fragmentry top plan view, showing two sections of the coping and the upper edge of the gutter at the intersection of two sections thereof.

The sections of coping C, such a 12 feet or other appropriate distance in length, are separated by a gap 23 of FIG. 3, which also extends downwardly below nose 12, as in FIG. 1, to permit a small amount of water to flow continuously into gutter G. This small flow of water will maintain a supply of water for the recirculation pumps, so that they will not run dry, as when all of the swimmers leave the pool and the level of water in the pool lowers and no more water is forced over the coping for some time, while the pool is not in use.

The gutter G inclues a base or bottom wall 25, a front wall 26 and an upwardly slanting, rear wall 27, being formed to shape from a sheet of corrosion-resistant metal, preferably stainless steel, as by a conventional brake or by dies. Gutter G provides a passage through which water which overflows the coping C and drains through slots 14 may be carried to a conventional filter and pump, or also a heater, for return to the pool. The front wall 26 is further provided with an outwardly offset flange 28 and an upwardly extending attachmentflange 29, with which the attachmentand adjustment means A is associated. As will be evident, flanges 16 and 17 of coping C and flanges 28 and 29 of gutter G provide a recess within which the attachement means A are located, so as to eliminate any projection into the pool of the attachement means A. The rear wall 27 of gutter G is further provided, at its upper edge, with a rearwardly extending, horizontal flange 30 connected to a vertical flange 31 and a rear flange 32, the upper surface of the latter being level with the deck 11 of the pool. The bolts 20 for attachement of the rearmost flange 19 of coping C to the rear wall of the gutter G may be welded to the flange 30, so as to extend upwardly through an appropriate hole in flange 19, as will be evident from FIG. 3.

Figure 8:
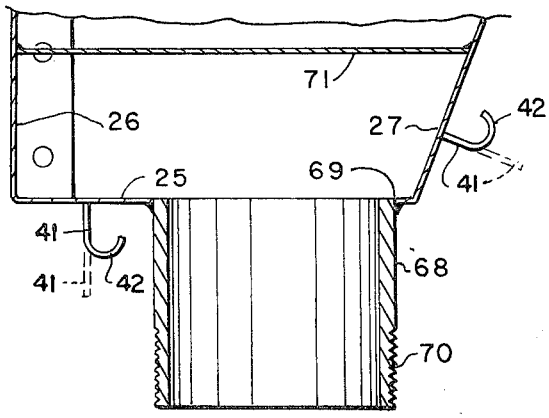
FIG. 8 is a fragmentary cross section, corresponding to a lower portion of the gutter of FIG. 2, but showing a drain pipe and cover plate therefor installed in the gutter.

The gutter G is further provided with a channel-shaped cross bar 34, welded in position between the rear wall 27 and the front wall attachement flange 29, at spaced positions along each gutter section. Each cross bar 34 is further provided with a series of holes 35, previously described in the cross brace 34 at each end, so that one gutter section may be attached to the adjacent gutter section, as by bolts 36 of FIG. 5, for assembly of the gutter sections as the top front of the form for pouring the concrete wall W for the pool. The front wall 26 of the gutter G may be further reinforced by a series of front braces, 37, such as angles, which extend between the bottom wall 25 and the underside of flange 28. Conveniently, the front braces 37 are spaced apart the same distance as the cross braces 34, as on the order of 2 feet, so that each cross brace may also be welded to a front brace. The rearwardly extending flange of each angle, front brace 27 may also be provided with a series of holes 35, so that the front braces at the ends of abutting gutter sections may be attached together, as by bolts 36 of FIG. 5. A series of spaced bottom braces 38 and rear braces 39 are preferably attached, as by welding, to the underside and rear of the respective bottom wall 25 and rear wall 27 of the gutter. Braces 38 and 39 again are conveniently angles and provided with holes 35 for attachment at the ends of the gutter sections, as well as for flow of the fluid concrete therethrough intermediate the ends, to assist in anchoring to the concrete of pool wall W. In this connection, it will be noted that the line 40 between adjacent gutter sections, as in FIG. 1, indicates abutment of the sections, rather than a gap between sections, as in the case of the sections of coping C. Also, as provided on the rear and underside of gutter G, as in FIG. 8, and shown on the alternative shape of FIG. 9, a series of elongted pins 41 may be welded, as by a special welding "gun", originally in straight position as shown by dotted lines, then bent around to provide a hook 42, as shown, to become embedded in the concrete and resist separation of the gutter from the concrete.

On theunderside of each guter G, spaced an appropriate distance from the front edge, a longitudinally extending angle 43 may be attached, as by welding, to be utilized for attachment of a form board 44 of FIG. 1. The depending front flange of angle 43 may be provided with a series of holes 45, as in FIG. 5, for attachement of the form board 44, as by conventional form ties. After the concrete of wall W has set, the form boards 44 are removed and a coating 46 of FIG. 2, as of epoxy resin, applied to the exposed inner surface 47 of FIG. 1 of the concrete. The epoxy resin coating may be sprayed onto the concrete surface, or applied in any other suitable manner, while a layer of conventional tile may be applied to the surface through the use of a mortar appropriate for swimming pools. Alternatively, the concrete surface 47 may be smoothed off by grinding and a layer of waterproof paint applied. As will be evident, the purpose of the coating 46 and other alternative treatments is both for waterproofing purposes and to provide a smooth surface which will not tend to injure or abrade a swimmer rubbing against the inner wall of the pool.

Each section of the coping and gutter may be perpendicular at the ends, except for the corner sections which, as in FIG. 1, may terminate at 45° edges, so that two perpendicular gutter and coping sections will fit together at the corner, with a gap 23′ between the coping sections. If desired, a special arcuate section may be used at the corner, having ends which are disposed at 90° to each other, and therefore will correspond to the perpendicular ends of the adjacent coping and gutter sections. This type of corner section is generally conventional, i.e. having an arc on the inside and an arc on the outside whose radius is taken from the intersecting projection of the lines of the perpendicular ends, and therefore is not illustrated. However, it will be understood that such corner sections will have all of the construction details of the straight coping and gutter sections shown, except perhaps for brace bar 21 at each end only and a cross brace 34 and front brace 37 at each end only ofthe curved section, although intermediate braces may also be utilized.

Figure 6:
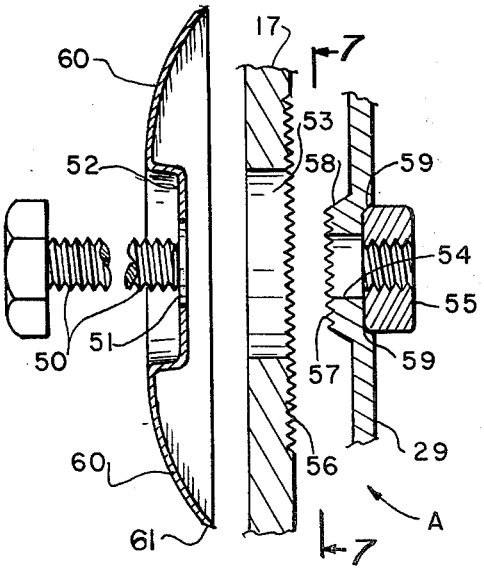
FIG. 6 is a fragmentary exploded view, on an enlarged scale and taken along line 6—6 of FIG. 5, through the adjustment means for the front edge of the coping.
Figure 7:
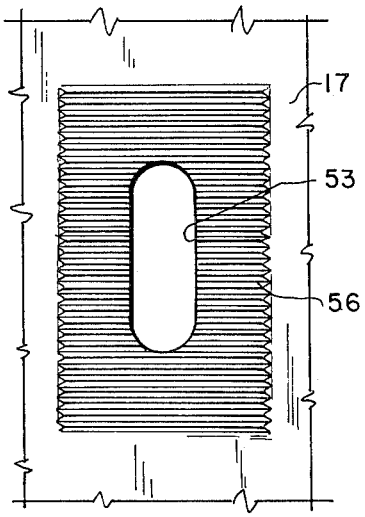
FIG. 7 is a fragmentary rear elevation of a portion, surrounding a slot, of a depending flange of the gutter, a section of such flange being shown in FIG. 6.

The connector or attachmentand adjustment means A, as in FIG. 6, may comprise a machine screw 50 which extends through a hole 51 in a rosette 52, a vertical slot 53 in flange 17 of coping C, a hole 54 in flange 29 of gutter G and into threaded engagement with a nut 55 secured, as by welding, to the rear side of flange 29. Slot 57 preferably has a width slightly greater than the outer diameter of the machine screw 50 and a length, as in FIG. 7, sufficient to provide adequate upward and downward adjustment of the top of nose 12 of the coping, as on the order of ¾ inch. A series of equally spaced, horizontal indentations and ridges 56 are formed on the rear side of adjustment flange 17, extending both above and below the slot 53, as well as to each side of the slot, as for a distance on each side corresponding to the width of the slot, as in FIG. 7. The ridges and indentations 56 are engaged by a corresponding series of ridges and indentations 57 on the front side of attachement flange 29 of the gutter, the indentations and ridges 57 being adapted to interfit with the ridges and indentations 56, so as to lock the two flanges together when screw 50 is tightened in nut 55. In forming the indentations and ridges 56 on the rear side of flange 17, a suitable dieis utilized, but with a flat backing plate which does not produce any additional deformation of either the front or rear surfaces of flange 17. However, the indentations and ridges 57 are preferably formed in an inward offset 58 of flange 29, which may be formed by utilizing a backing die which produces a recess 59 on the rear side of flange 29, as well as offsetting the material 58 forwardly. As will be evident, nut 55 is conveniently attached, as by spot welding, in the recess 59. The inward offset of ridges and indentations 57 permits a clamped engagement thereof with indentations and ridges 56, as well as relativemovement between the two for adjustment purposes without frictional interference by the opposed flange surfaces. For reasons pointed out later, seepage between the flanges is not objectionable but, in fact, desirable. Rosette 52 may be formed, as by stamping, to provide an outer ring 60 which is arcuate in cross section with its outer edge 61 initially engageable with flange 17 and the convex part thereof facing inwardly toward the pool and having an outer diameter greater than twice the length of slot 53. Thus, rosette 52 has the multiple purpose of not only covering slot 53 and also surrounding the head of machine screw 50 and protecting the user of the pool from engagement with the head, but alsoto act as a lock washer for screw 50.

Figure 4:
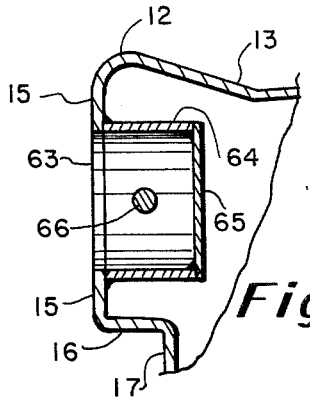
FIG. 4 is a fragmentary cross section, on an enlarged scale, and taken along line 4—4 of FIG. 3, through an anchor cup for attachement of line markers and the like installed in the front wall of the coping.

The lane anchors L are installed in a spaced series of holes 63 in the front depending flange 15 of the coping C. Each lane anchor L, as in FIG. 4, may include a tube 64 welded to the inside of flange 15, around the corresponding hole 63, while a circular plate 65 is attached, as by welding, to the rear edge of tube 64. A horizontal cross rod 66 extends laterally of tube 64, with the ends of rods 66 being attached, as by welding, to the inside of tue 64, or extending through holes at opposite sides of tube 64 and welded to the outside of the tube, prior to attachment to the coping.

Depending upon the size of the pool, the gutter G may be provided with one or more drain pipes, for draining water from the gutter to the pump which returns the water to the pool, such as aftern filtering. Such a drain pipe may extend to the pump from the bottom of the gutter at an appropriate position, such as along one side or one end of the pool. Such a drain pipe may include a short drain pipe section 68, as in FIG. 8, which is welded to the bottom 25 of the gutter at a hole 69 having an appropriate diameter. The lower end of short drain pipe section 68 is provided with threads 70, for attachement of the remainder of the drain pipe after the gutter and concrete forms have been installed, but before the concrete is poured. In order to minimize the surges of water through the drain pipe, a baffle plate 71 may be attached, as by welding, between the front wall 26 and rear wall 27 of the gutter. Plate 71 is spaced a short distance above the opening 69, such as less than the diameter of the opening, while the lateral extent of baffle plate 71 may be on the order of twice the diameter of the drain pipe section 68.

Figure 9:
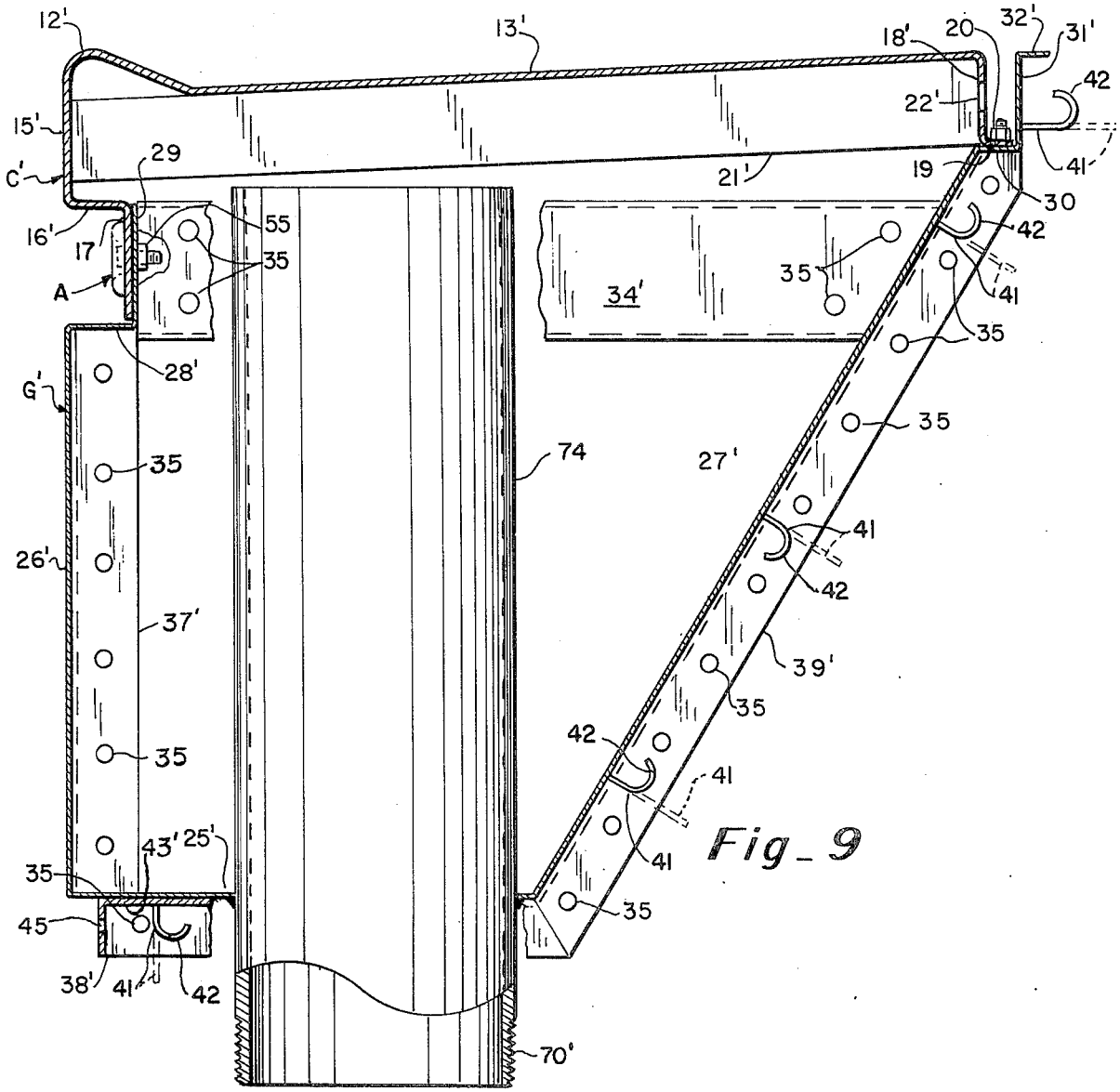
FIG. 9 is a cross section of an alternativeshape of gutter and coping and showing also an overflow pipe installedin the gutter.

An alternative shape of the coping and gutter, as for larger pools, is shown by the coping C′ and gutter G′ of FIG. 9.Coping C′ is wider from front to rear and slightlyhigher than the coping C of FIG. 1, while gutter G′ is also slightly higher than gutter G and hs a greater capacity for flow of drain watr therethrough. However, the parts of coping C′ are similar, including a slightly higher nose 12′, a wider drain section 13′ having slots therein of the same size and spacing as slots 14 of FIG. 3, a slightly higher, depending flange 15′, and a slightly wider, readwardly extending, offset flange 16′, but a depending attachment flange 17 of the same size as flange 17 of FIG. 2. The coping C′ is also provided with a deeper rear depending flange 18′, having a slightly larger weep hole 22′ therein, and a horizontal flange 19 by which the rear edge of the coping is attached to the gutter by bolts 20, as before. The sections of coping C′ are also installed with a gap therebetween similar to gap 23 between the sections of coping C, as in FIGS. 1 and 3. The brace bar 21′ of coping C′ may be thicker and deeper than brace bar 21 of FIG. 2, because of the added distance between the front flange 15′ and rear flange 18′.

The gutter G′ is provided with a wider bottom wall 25′ and a higher front wall 26′, which is provided at its upper end with a wider, rearward offset flange 28′ but an upstanding attachment flange 29 having the same height as before. The attachment flanges17 and 29 are attached together by an attachment and adjustment means A, which may be the same as that previously described. The higher rear wall 27′ of the gutter G′ may be provided, at its upper edge, with a rearwardly extending flange 30 connected to a higher, upwardly extending flange 31′ and a wider horizontal top rear flange32′. The upper surface of flange 32′ is again level with the deck of the pool and may also be utilized in leveling the gutter as part of the concrete form and also in striking the surface of the concrete of the deck. The cross brace 34′ is longer than the cross brace 34 of FIG. 2, but is provided with a similar pattern of holes 35 therein. Again, a front reinforcing angle 37′ extends from the bottom wall 25′ to the inwardly offset flange 28′. The angle brace 37′, bottom brace 38′, rear brace 39′ and form tie attachment angle 43′ may have wider flanges than the corresponding braces or angles of FIG. 2, but angle 43′ may be provided with a series of similar spaced holes 45 for attachement of form ties. The sections of the gutter G′ are attached together in abutting relation, as in a manner similar to that shown in FIG. 5 for the sections of gutter G, while a pool utilizing gutter G′ will also be provided with one or more drain pipe sections, corresponding to section 68 of FIG. 8.

The gutter G′ of FIG. 9 is also shown as provided with a series of pins 41 on the bottom and rear sides, which may be attached by a suitable welding "gun" in the straight position of the dotted lines, but are bent at the ends to form hooks 42, as indicated previously. The purpose of the hooks 42 is to become embedded in the concrete and to resist any tendency for separation of the gutter from the concrete. The pins 41 may be placed at appropriate distances apart, such as on the order of 6 to 8 inches, both on the bottom and on the rear of the gutter.

An overflow pipe 74 is also shown in FIG. 9, it being understood that it is normally located at one or only a few positions around the perimeter of the pool, such as at one side or one end or on opposite sides or ends, depending upon the size of the pool and the volume of water to be accommodated. It will also be understood that a pool having coping C and gutter G of FIGS. 1–5 will be provided with a similar overflow pipe. Overflow pipe 74 is attached, as by welding, to the bottom 25′ of the gutter and extends through an appropriate hole therein, so as to extend a short distance below the gutter, while the lower end of overflow pipe 74 has threads 70′, for attachmentof the remainder of the overflow pipe prior to pouring of the concrete. Pipe 74 is provided for the purpose of draining excess water from the gutter and to prevent overflow into the area surrounding the pool. The overflow pipe has an appropriate diameter and may extend upwardly, as in FIG. 9, to a point just above the level of the cross braces 34′ of the gutter. As will be evident, the gutter G′ will carry a considerable volume of water and the overflow pipe 74 may not be in use for long periods of time, or, hopefully, at all. Overflow pipe 74 will, however, drain excess water from the gutter, in the event additional fresh water is turned into the pool without an appropriate reduction in the return flow to the pool, or merely an abnormal amount of splashing, or any other contingency which produces a tendency for the gutter to overflow onto the deck and thence to adjacent areas.

As has previously been noted, a slight clearance between the attachmentflanges 17 and 29 is unobjectionable. In this connection, it will be noted that the return flow pumps for filtering or otherwise treating and then returning water to the pool are normally left in continuous operation. During the time that the pool is in use, the splashing of water by swimmers over the nose 12 of coping C or nose 12' of coping C' will ordinarily produce sufficient flow to maintain the return flow pumps in adequate operation. However, if a large number of persons leave the pool and the pool is emptied of swimmers, the level of the pool will drop, and there will be no more splashing to project water over the coping and into the gutter. Thus, it may happen that the gutter will run substantially dry before the pumps have returned sufficient water to the pool to again cause an overflow. The return flow pumps are often of a type which require priming to start, so that, as the pumps run dry and lose their prime, they may continue to operate, with the possibility of damage to the moving parts, as well as the niusance of repriming the pumps on starting their pumping operation again. The leakage through the gaps 23 between adjacent sections of the coping, as well as any slight leakage which may occur between attachement flanges 17 and 29, should provide sufficient water flowing in the gutter to prevent the return flow pumps from becoming dry until the water level can be raised again. It will be noted that the gap 23 between adjacent coping sections extends downwardly and then outwardly to the upper edge of the gutter attachment flange 29, so that the area of each gap 23 through which water will flow includes not only the distance from the water level to the bottom of flange 15 or 15' of the coping, but also the areabetween adjacent offset flanges 16 and 16'.

It will be noted that heated water is preferably supplied to the pool through pipes connected to the bottom of the pool, rather than the sides, to provide a more uniform temperature in the pool. Also, for competition pools, the outward offset formed between the coping C and gutter G, in which the adjustment devices A are located, provides a convenient location for a rail along which one or more carriages may be moved for adjustment to provide pool lanes of different lengths, as in yards or meters. The offset area may be made higher, if desired, so that a rail may be mounted on gutter flange 28 along which a set of rollers at each end of the carriage may move, such rollers conveniently being cylindrical stainless steel pins which extend into bronze bushings mounted in the carriage, thereby accommodating slight variations in the width of the pool. To retain the rollers in position, each roller may be provided with a circumferential groove engaging a longitudinal flange on the aforesaid rail.

Figure 10:
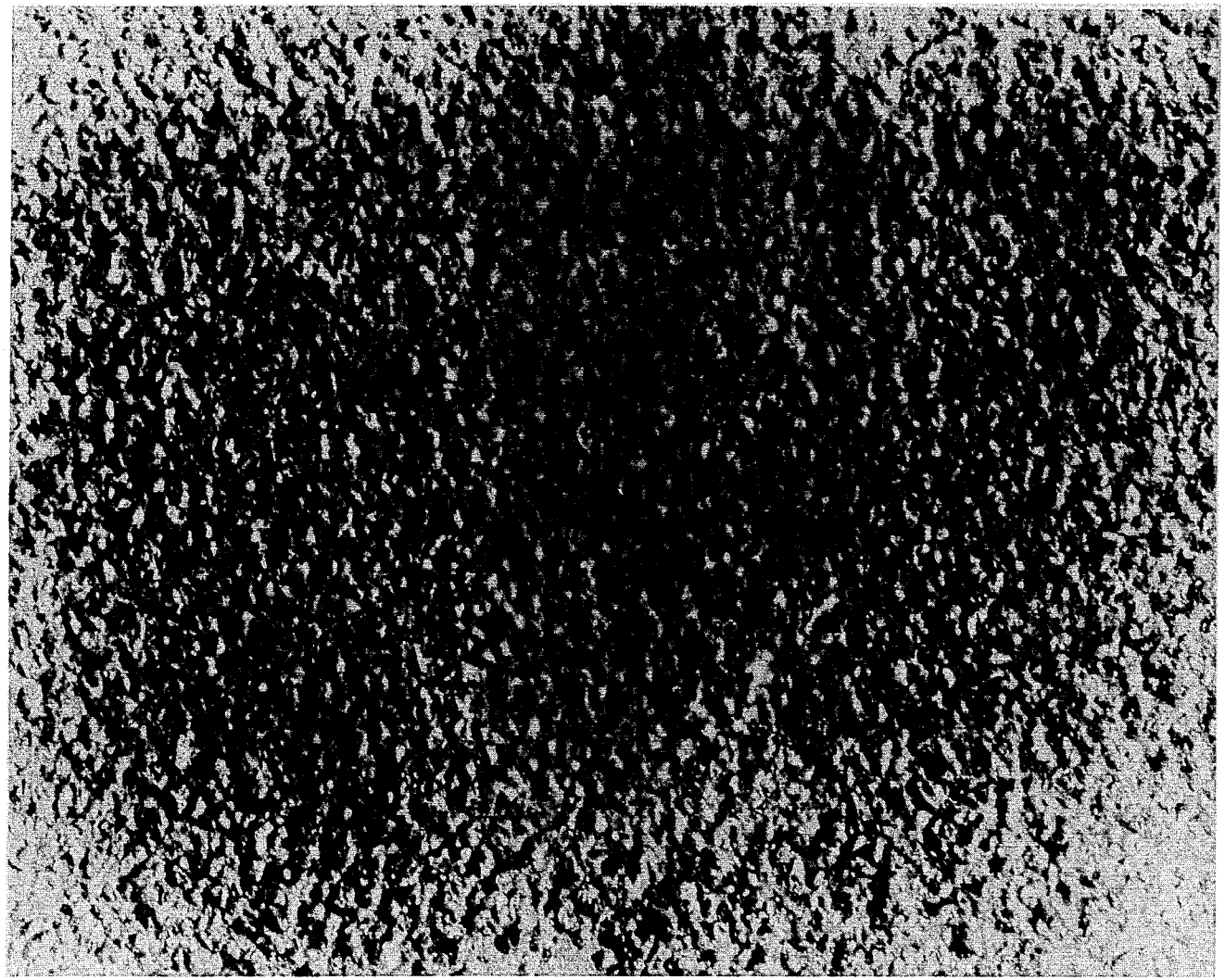
FIG. 10 is a reproduction of a microphotograph, at an enlargement of 160×, of a sandblasted stainless steel surface, as produced for utilization on the coping.

In FIG. 10 is shown a reproduction of a microphotograph taken at an enlargementof 160 times, with oblique lighting, of a portion of a sandblasted piece of 18/8 stainless steel as used for a section of coping C. The microscopic rounded protuberances and ridges between depressions and valleys, evident in FIG. 10, provide a surface which is non-slipping, even when wet, particularly for human skin, as well as for other reasonably soft surfaces, such as rubber soledsandals and the like. Conveniently, one entire surface of the sheet, from which a section of coping C is to be formed, is sandblasted, prior to bending or stamping slots 14 therein, while any portions of the surface on which thesandblasted effect appears to have been reduced, after bending and formation of the slots, is again sandblasted. For this purpose, an appropriate sandblasting gun may be moved to and fro in perpendicular directions until a substantially uniform grey color is produced. The capacity of the gun and the size of the sand, together with the distance between the gun nozzle and the sheet, should be selected so that warping of the sheet is prevented, thereby avoiding any inconvenience in bending or stamping operations. Apparently, if the sandblasting gun is placed too close to the sheet, a swaging or cold working effect is produced.

The sandblasted surface shown enlarged in FIG. 10 was produced through use of a Clemco SCW 1648 sandblasting gun, manufactured by Clemco-Clementensin, Inc. of San Francisco, Cal., using Wedron No. 40-98, obtained from the Wedron Silica Co. of Wedron, Ill., as the sandblasting sand. The specifications for the Wedron No. 40-98 sand are as follows:

| American Foundry Society Screen No. | | % Retained on Screen |
|---|---|---|
| No. 20 | | 2.2% |
| No. 30 | | 38.6% |
| No. 40 | | 57.6% |
| No. 50 | | 1.4% |
| No. 70 | | 0.2% |
| | Total | 100.0% |

The nozzle of the sandblasting gun was held at approximately 1 foot from the surface being sandblasted, while compressed air was supplied to the gun at a gauge pressure of 100 to 120 pounds per square inch. It will be understood that othermakes of sandblasting guns should be found appropriate, as well as other types of sand and other distances of the gun nozzle from the sheet.

Although preferred embodiments of this invention have been illustrated and described and variations therein indicated, it will be understood that other embodiments may exist and other variations made, all without departing from the spirit and scope of this invention.

What is claimed is:

1. A rim flow swimming pool coping assembly having a nose over which water will flow to maintain a desired depth of water in the pool, comprising:

a. a longitudinally extended, corrosion resistant sheet having an upstanding nose at its front edge and a front wall depending from said nose, said sheet having a top wall extending rearwardly from said nose for a predetermined distance and having slots therein for drainage of water to a drain beneath said top wall;

b. support means for said sheet including a front support extending at a front position upwardly to said front wall which is disposed in overlapping relation to said support;

c. said support means having a rear support for said sheet;

d. means connecting said sheet to said rear support; and e. means at longitudinally spaced positions along said front wall connecting said front wall and front support, said connecting means being adjustable to permit adjustment of said front nose upwardly and downwardly.

2. A coping assembly as defined in claim 1, wherein:

said support is adapted to be embedded in concrete and is in a fixed position after the setting of said concrete;

said support has a planar surface adjacent said rear support for leveling said support prior to pouring of concrete; and said connecting means is adjustable not only prior to but also after the pouring and setting of said concrete.

3. A coping assembly as defined in claim 1, wherein each said connecting means comprises:

a hole in said front support and an upright slot in said front wall adapted to register with said hole;

a nut attached to the inside of said support and surrounding said hole;

a bolt extensible through said slot and hole into threaded engagement with said nut; and a spring element for retaining said bolt in an adjusted position for protecting users of the pool from engagementwith the head of said bolt, said spring element having a flange whose diameter is greater than twice the length of said slot and a central section offset at said flange from said front wall and having a central recess for the head of said bolt.

4. A coping assembly as defined in claim 1, wherein:

at least the upper exposed surfaces of said assembly are provided with microscopic protuberances and indentations of a type producible by sandblasting.

5. A coping assembly as defined in claim 1, wherein:

a. said front wall is provided with an outward offset and a flange depending from said outward offset; and b. said connecting means engage said depending flange.

6. A coping assembly as defined in claim 5, wherein:

a. a front flange depends from said nose to said outward offset;

b. a generally vertical rear flange depends from the rear edge of said top wall and is provided with spaced holes therein;

c. a generally horizontal rear flange extends rearwardly from the base of said vertical rear flange; and d. a series of longitudinally spaced brace bars extend laterally from said front flange to said rear vertical flange and are attached thereto to abut the underside of said top wall.

7. A coping assembly as defined in claim 5, wherein:

the rear of said depending flange is provided with lateral, equidistant indentations and ridges at the position of each said adjustment means for interfitting with corresponding lateral, equidistant indentations and ridges of an upstanding flange of a support for said front wall of said coping section, for repeated adjustment of the elevation of said nose.

8. A coping assembly as defined in claim 7, including:

a. an upright slot in said coping flange at the position of each adjustment means, said indentations and ridges being disposed both above and below and at each side of said slot;

b. said supporting flange is provided with a forward offset on the front of which said corresponding indentations and ridges are located, with a hole through said offset adapted to be placed in alignment with said slot and a nut attached to the rear of said forward offset in alignment with said hole;

c. a headed screw insertable through each said slot and hole for engagement with said nut for clamping said coping flange and supporting flange together with selected ridges and indentations interfitting; and d. a rosette having a diameter greater than twice the length of said slot, a central hole for said screw and a front recess surrounding said hole for receiving the head of said screw.

9. A rim flow swimming pool comprising:

a series of connected coping assemblies as defined in claim 1;

a series of connected gutter assemblies on which said coping assemblies are mounted, including:

a corrosion resistant sheet having a bottom wall, a front wall and a rear wall having at its upper edge a rearwardly extending flange;

said gutter assemblies being constructed and arranged to be connected to a series of similar gutter assemblies,with said upper rear flanges thereof providing not only transit leveling position, but also a striking surface for a concrete deck portion of said pool;

said front wall of said gutter assemblies being provided with an outward offset and an upstanding flange extending from the rear edge of said offset, said flange being adapted to support the front wall of a copig assembly; and said rear wall being provided with a ledge for supporting the rear edge of said coping assembly.

10. A rim flow swimming pools as defined in claim 9, wherein:

a series of braces extend between said rear wall and said upstanding flange of said gutter assemblyand between said bottom wall and said outward offset of said front wall, said braces being disposed at spaced positions along said gutter assemblies, including the ends thereof, so that abutting braces of abutting gutter assemblies may be connected together at such ends;

said front walls of said coping assemblies having outward offsets and flanges depending from said outward offsets;

said front depending flanges and upstanding flanges of said coping and gutter assemblies have, at corresponding spaced points, a series of lateral, equidistant ridges and indentations with selected ridges and indentations in interfitting relation;

releasable clamping means extend through said spaced points for maintaining said selected interfitting ridges and indentations in engagement; and said coping assemblies have lateral brace bars extending between and attached to said front depending flange and the rear of said coping to abut the underside of said coping top wall.

* * * * *